US005573643A

United States Patent [19]

Jaakkola et al.

[11] Patent Number: 5,573,643

[45] Date of Patent: *Nov. 12, 1996

[54] TWIN WIRE WEB FORMER IN A PAPER MACHINE

[75] Inventors: Jyrki Jaakkola, Korpilahti; Seppo Kiviranta, Jyväskylä ; Ari Linsuri, Muurame; Michaell Odell, Jyväskylä ; Antti Poikolainen, Jyväskylä ; Samppa Salminen, Jyväskylä , all of Finland

[73] Assignee: Valmet Corporation, Helsinki, Finland

[ * ] Notice: The term of this patent shall not extend beyond the expiration date of Pat. No. 5,395,484.

[21] Appl. No.: 246,176

[22] Filed: May 18, 1994

Related U.S. Application Data

[63] Continuation-in-part of Ser. No. 6,372, Jan. 19, 1993, Pat. No. 5,395,484.

[30] Foreign Application Priority Data

Jan. 17, 1992 [FI] Finland ..... 920228
May 18, 1993 [FI] Finland ..... 932265

[51] Int. Cl.[6] ..... D21F 1/00

[52] U.S. Cl. ..... 162/203; 162/300; 162/301

[58] Field of Search ..... 162/203, 300, 162/301, 352

[56] References Cited

U.S. PATENT DOCUMENTS

| | | | |
|---|---|---|---|
| 4,544,449 | 10/1985 | Arav | 162/352 |
| 4,614,566 | 9/1986 | Koponen et al. | 162/301 |
| 4,744,866 | 5/1988 | Koponen et al. | 162/203 |
| 4,769,111 | 9/1988 | Nevalainen et al. | 162/351 |
| 5,167,770 | 12/1992 | Bubik et al. | 162/301 |
| 5,202,000 | 4/1993 | Phillips | 162/301 |
| 5,215,628 | 6/1993 | Koivuranta et al. | 162/301 |
| 5,282,933 | 2/1994 | Bubik et al. | 162/301 |
| 5,387,320 | 2/1995 | Jaakkola | 162/301 |
| 5,395,484 | 3/1995 | Odell et al. | 162/301 |

FOREIGN PATENT DOCUMENTS

| | | |
|---|---|---|
| 0373133 | 6/1990 | European Pat. Off. . |
| 0371786 | 6/1990 | European Pat. Off. . |
| 0489094 | 3/1991 | European Pat. Off. . |
| 0552139 | 7/1993 | European Pat. Off. . |
| 885609 | 12/1988 | Finland . |
| 885607 | 12/1988 | Finland . |
| 885606 | 6/1990 | Finland . |
| 911281 | 3/1991 | Finland . |
| 913112 | 6/1991 | Finland . |
| 905447 | 5/1992 | Finland . |
| 920863 | 12/1992 | Finland . |
| 920228 | 7/1993 | Finland . |
| 3329833 | 3/1984 | Germany . |
| 3927597 | 2/1991 | Germany . |
| 4002305 | 8/1991 | Germany . |
| 9102842 | 3/1991 | WIPO . |

*Primary Examiner*—Karen M. Hastings
*Attorney, Agent, or Firm*—Steinberg, Raskin & Davidson, P.C.

[57] ABSTRACT

A twin-wire web former in a paper machine, having a single-wire initial portion, after which a twin-wire zone starts in the area of a ribbed deck of a first forming shoe placed inside one of the wire loops. After the first forming shoe, a pressure-loaded dewatering unit is arranged and which includes opposite sets of ribs and dewatering chambers. A first dewatering chamber in the dewatering unit is placed above the first forming shoe so as to remove water that drains from the area of the curved ribbed deck of the first forming shoe through its suction-deflector duct. The first dewatering chamber is followed by a second dewatering chamber, whose lower part is connected with a set of dewatering and guide ribs having gap spaces into which a drain duct of the second dewatering chamber opens. Against the set of dewatering and guide ribs, a set of loading ribs operates, which is placed inside the opposite wire loop and which operates by means of the medium pressure of loading hoses.

18 Claims, 3 Drawing Sheets

TWIN WIRE WEB FORMER IN A PAPER MACHINE

This application is a continuation-in-part of U.S. Patent application Ser. No. 08/006,372 filed Jan. 19, 1993, now U.S. Pat. No. 5,395,484.

BACKGROUND OF THE INVENTION

The present invention relates to a twin-wire web former in a paper machine, comprising a single-wire initial web forming portion, preferably a substantially horizontal initial portion, or an equivalent web forming zone such as a twin-wire zone placed in connection with a forming roll. After the initial web forming portion, a twin-wire forming zone starts in the area of or in proximity to a ribbed deck of the first forming shoe placed inside one of the wire loops. The present invention also relates to a method for dewatering a web in a twin-wire forming zone.

In the assignee's Finnish Patent No. 75,375(corresponding to U.S. Pat. Nos. 4,614,566 and 4,744,866 assigned to the assignee herein, the disclosures of which are hereby incorporated by reference herein), a web former of a paper machine is described which constitutes one of the starting points of the present invention. The web former described in FI '375 is utilized in particular for modernizations of Fourdrinier wire parts. This web former comprises a lower-wire loop placed in connection with the headbox of the paper machine and forming a single-wire, usually horizontal initial portion of the dewatering zone, in which zone water is drained through the lower wire by means of dewatering members out of the web that is being formed. The web former also comprises an upper-wire unit, in which an upper wire is guided by guide and web-forming rolls. The upper wire together with the run of the lower wire form a twin-wire dewatering zone which starts at the first forming roll. The first forming roll is placed inside the loop of the upper wire and is provided with an open hollow face. After the first forming roll, a forming slope is arranged in the twin-wire dewatering zone inside the loop of the lower wire. The forming shoe has a curved deck that guides the loop of the lower wire and whose curve centers or center are/is placed at the side of the lower wire loop. After the forming shoe, an additional forming roll is arranged inside the loop of the lower wire. The forming roll guides the twin-wire forming zone and has a guide sector on which the run of the twin-wire forming zone is curved downward.

Substantially the entire twin-wire forming zone in accordance with FI '375 is situated above the level determined by the single-wire initial portion. The twin-wire forming zone is curved upward from the plane of the initial portion on a sector of the first forming roll. After the initial dewatering has taken place to a suitable extent, e.g., through the lower wire in the single-wire initial portion, additional dewatering takes place in the twin-wire dewatering zone initially on the sector of the first open forming roll in two directions through both of the wires. In the area of the next forming shoe, the dewatering takes place primarily upwards through the upper wire. Thereafter, the dewatering pressure is increased further in the area of the second forming roll while the dewatering still takes place primarily through the upper wire.

The web formers described in FI '375 and other, corresponding formers have been marketed by the assignee during the last 10 years (since the early 1980's ) under the trade marks "Sym-Former" and "Sym-Former R". From the use of these formers in several different applications, a considerable amount of operating experience has been obtained and has provided the background and the starting point for the present invention.

With increased running speeds of paper machines, several problems in the web formation have been manifested with increased emphasis. In the former section of a paper machine, the phenomena that act upon the fiber mesh and upon the water, which is still relatively free in connection with the fibre mesh, such as centrifugal forces, are generally increased in proportion to the second power of the web speed. The highest web speeds of some existing paper machines are already of an order of about 1500 meters per minute. However, machines are being planned in which a web speed of about 2000 m/min or even higher web speeds will be possible.

With respect to the prior art related to the present invention, reference is also made to U.S. Pat. No. 4,769,111 granted to Messrs. A. Ahlstrom Corporation, to the assignee's Finnish Patent Application No. 885609, as well as to the Finnish Patent Application No. 885606 and 885607 of Messrs. Valmetit Ahlstrom Inc., in which formers marketed under the assignee's trade mark "MB-former" are described.

Further, reference is made to the assignee's Finnish Patent Application No. 904489(corresponding to U.S. pat. No. 5,215,568, the specification of which is hereby incorporated by reference herein), 911281(corresponding to U.S. patent application Ser. No. 07/850,505, the specification of which is hereby incorporated by reference herein), 913112(corresponding to U.S. Patent application No. 07/903,603, the specification of which is hereby incorporated by reference herein), and 920228(corresponding to U.S. pat. application Ser.No. 08/006,372, the specification of which is hereby incorporated by reference herein), in which various combination concepts of an MB formers and hybrid and gap formers are described.

OBJECTS AND SUMMARY OF THE INVENTION

Accordingly, it is an object of the present invention to further develop the applications of the prior-art MB units as well as to provide novel advantageous combinations of these MB units and especially of hybrid formers.

It is a further object of the present invention to provide such a twin-wire former, in particular a combination of a hybrid former and a MB former, by whose means it is possible to achieve good base formation and formation of the web while maintaining a satisfactory retention level also at increased web speeds.

Another object of the present invention is further development of the formers described in Finnish Patent No. 75,375 and corresponding "Sym-Former" and "Sym-Former R" formers so that their running speeds can be increased, e.g., in connection with modernizations of such existing paper machines, to a considerably higher level, typically to a speed range of from about 1200 meters per minute to about 1500 meters per minute, so that neither the dewatering capacity nor the formation of the web accomplished in the former constitutes an obstacle for an increased speed.

It is a further object of the present invention to provide a former in which, if necessary, the increased dewatering capacity can be utilized, besides providing a higher web running speed, also to produce a thicker grade of paper and/or enable a lower consistency in the headbox. The lower consistency in itself improves many properties of the paper.

Even though the most popular embodiments of the invention are related to further development of hybrid formers in accordance with Finnish Patent 75,375 and typically in connection with modernizations of these hybrid formers, it should be emphasized that the scope of the invention also includes corresponding gap formers, of which representative examples are given, e.g., in the assignee's Finnish Patent Application No. 920863, filed on Feb. 26, 1992.

In view of achieving the objects stated above, those that will come out later, and others, the invention comprises a pressure-loaded dewatering unit arranged after a first forming shoe. The dewatering unit is provided with opposite sets of ribs and with dewatering chambers. A first dewatering chamber in the dewatering unit is placed above and in proximity to the first forming shoe so that water that drains from the area of the curved ribbed deck of the first forming shoe is substantially removed through a suction-deflector duct. The first dewatering chamber is followed by a second dewatering chamber whose lower part is connected with a set of dewatering and guide ribs which are preferably fixed to the dewatering unit. Gap spaces between the dewatering and guide ribs communicate with the opening of the drain duct of the second dewatering chamber. Against the set of dewatering and guide ribs, a set of ribs placed inside the opposite wire loop operates. This set of ribs is preferably a set of loading ribs that operates by means of the medium pressure of the loading hoses.

In the invention, when a pressure-loaded MB twin-wire zone and a preceding forming shoe arranged inside the lower wire and provided with a curved ribbed deck in the initial portion of the twin-wire zone of the former are employed, the dewatering capacity of the paper machine can be increased. In addition, it is also important that the formation of the web can be improved while the retention remains at a satisfactory level.

In a preferred embodiment of the invention, the MB twin-wire zone is preceded by a dewatering chamber arranged above the first forming shoe. This dewatering chamber is directly followed by a second dewatering chamber arranged above the MB zone. Out of the chambers, water is removed through drain ducts which are preferably placed at the driving side of the machine only. In hybrid formers, the dewatering chambers are placed in the space between the first guide roll placed inside the loop of the upper wire, and the first forming roll. On the first forming roll, the twin-wire zone is curved upwards after the MB zone whereupon there are preferably dewatering members in accordance with the "Sym-Former" concept, e.g., a second forming shoe and a second forming roll placed inside the loop of the lower wire.

With respect to the dry solids content of the web, when the MB zone in accordance with the invention is reached, the dry solids content of the web ($k_1$) is preferably in the range from about 1.0% to about 3%, preferably in the range of 1.2% to about 1.8%. In this case, the loading ribs in the MB zone produce an efficient dewatering that improves the formation and that takes place both through the upper wire and through the lower wire. In the invention, it is important that the web is symmetrically dewatering so that the structure of the web in the z-direction can also be made sufficiently symmetric in respect of the distribution of fillers and fines.

The method for dewatering a web in a forming section having a twin-wire zone formed between an upper wire and a lower wire, includes the steps of: arranging a forming shoe comprising a curved ribbed deck in a loop of the lower wire, drawing water that has been removed from the web in the area of the curved ribbed deck into a first dewatering chamber via a first drain duct, providing an upper set of ribs in a loop of the upper wire, and drawing water from the web through gap spaces defined between the upper set of ribs into a second dewatering chamber via a second drain duct. The second dewatering chamber is arranged after the first dewatering chamber in the running direction of the web. A lower set of ribs is arranged opposite the upper set of ribs, and is loaded to press the lower wire and force water from the web.

In preferred embodiments of the method, it is possible to regulate the pressure applied to the lower set of ribs in the running direction of the web and/or in a direction transverse to the running direction of the web. To define the size and shape of the first drain duct, a form rib may be arranged proximate to the first drain duct. The form rib is replaceable and therefore is detachably connected to a lower wall of the first dewatering chamber. The method may be applied in any web former in which there is a twin-wire forming zone regardless of the initial method of formation of the web, e.g., gap former, hybrid former, etc.

In the following, the invention will be described in detail with reference to some exemplifying embodiments of the invention illustrated in the figures in the accompanying drawing. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
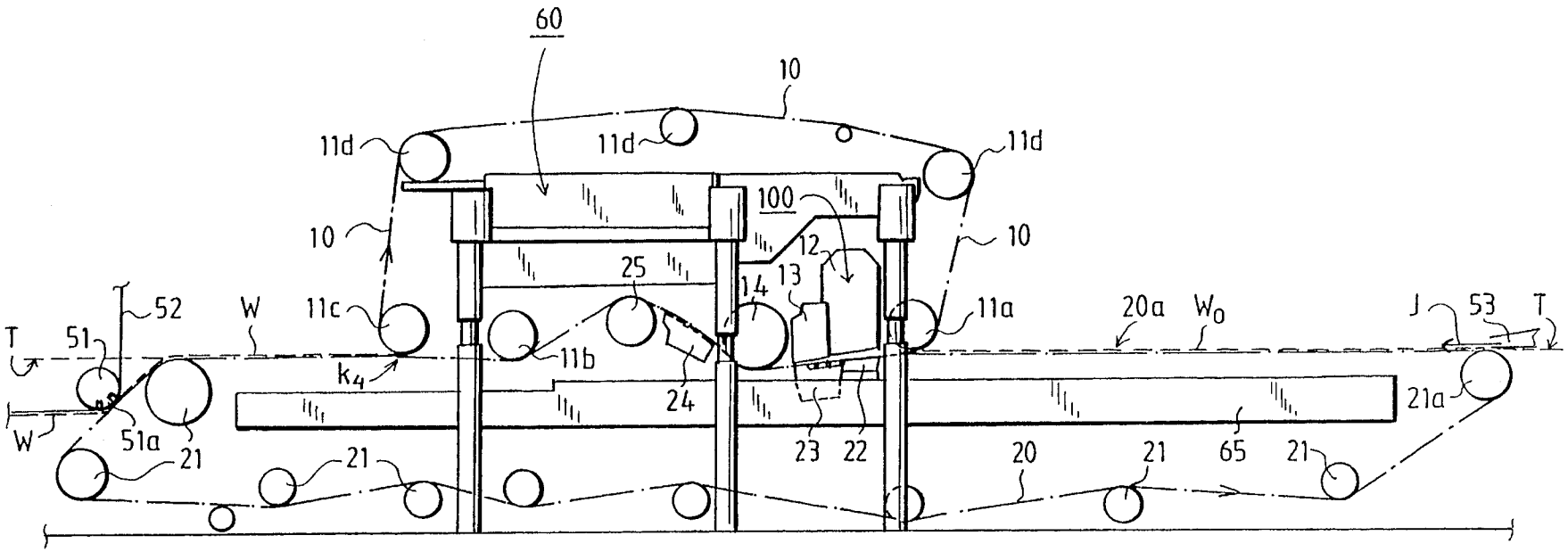
FIG. 1 is a schematic side view of a hybrid-MB former combination in accordance with the present invention.
Figures 2, 4:
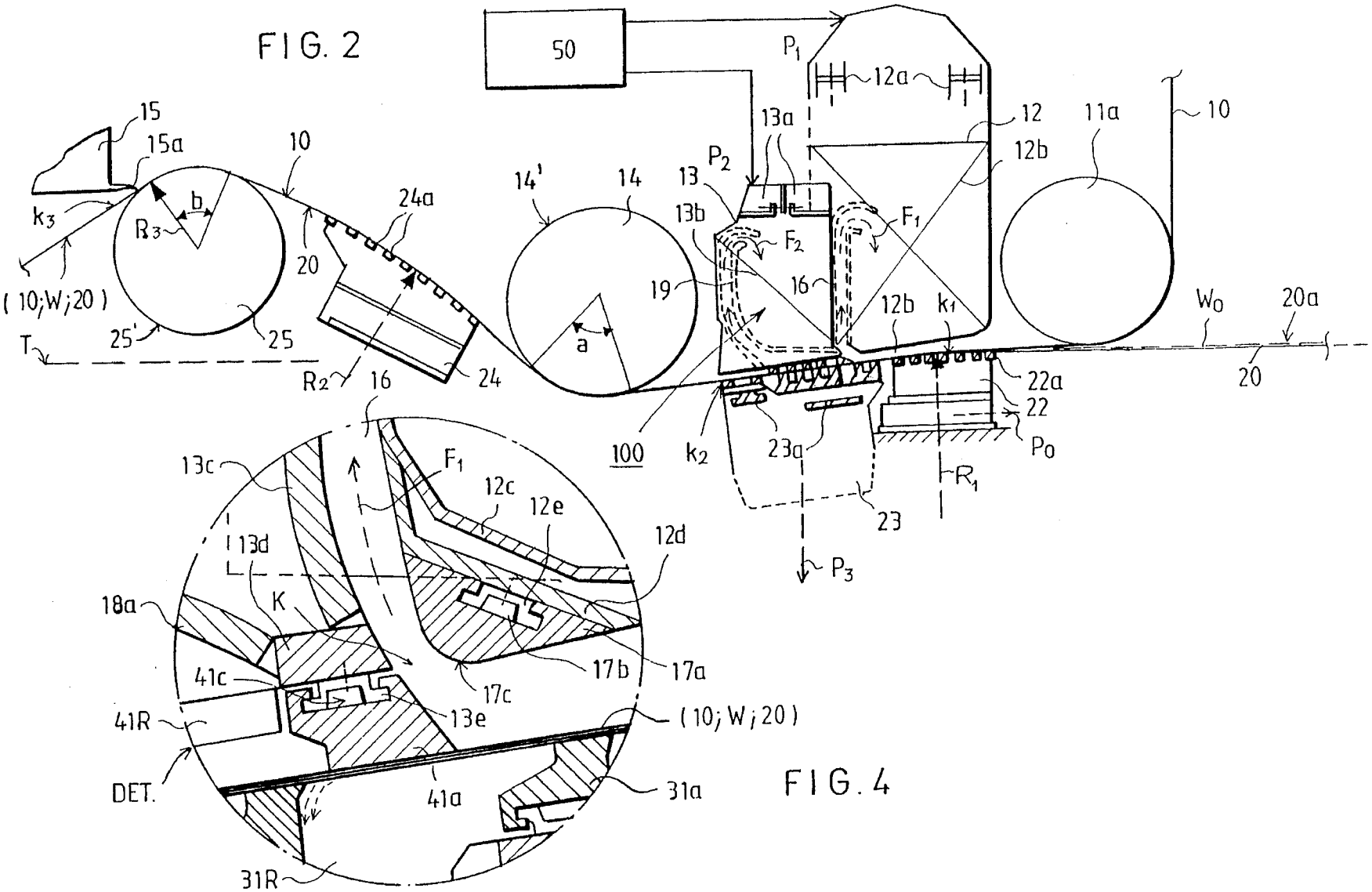
FIG. 2 is a schematic vertical sectional view in the machine direction of the initial part of the twin-wire zone in a hybrid former in accordance with the invention.
FIG. 4 is a vertical sectional view in the machine direction and on an enlarged scale of the detail DET encircled by the dashed-dotted line in FIG. 3.

Referring to the drawings wherein like reference numerals refer to the same elements, a hybrid former shown in FIGS. 1 and 2 comprises a lower wire 20 guided by guide rolls 21. A pulp suspension jet J is fed out of a discharge opening 53 of a headbox (not shown) onto a single-wire initial portion 20*a* of the lower wire 20. The paper web $W_O$ that is formed on this initial portion 20*a* runs a distance on the single-wire initial portion in a plane T—T so that it reaches a certain degree of couching on its face placed against the lower wire 20 before the twin-wire zone starts. The run of the lower wire 20 is guided outside the twin-wire zone by a breast roll 21*a* and by the guide rolls 21. Further, FIG. 1 shows the frame part 65 placed inside the loop of the lower wire 20. The frame part is, for example, a part of the frame of an existing Fourdrinier wire part which has been modernized to make a twin-wire hybrid former in accordance with the invention. The former also includes an upper-wire unit 60 which includes the frame part 61.

A twin-wire forming zone starts at a first forming shoe 22 and ends at a guide roll 11*c* of the upper wire 10, after which the web W follows the lower wire 20. The run of the upper wire is guided outside the twin-wire zone by a first guide roll 11*a* and by a latter guide roll 11*c* as well as by upper guide rolls 11d.

The former shown in FIG. 1 is typically a "Sym-Former R"modernized from an existing Fourdrinier former, which has been provided with a MB unit 100 placed and fitted, in accordance with the invention, at the beginning of the twin-wire zone in order to increase the dewatering capacity and/or to improve the web W formation.

Figure 3:
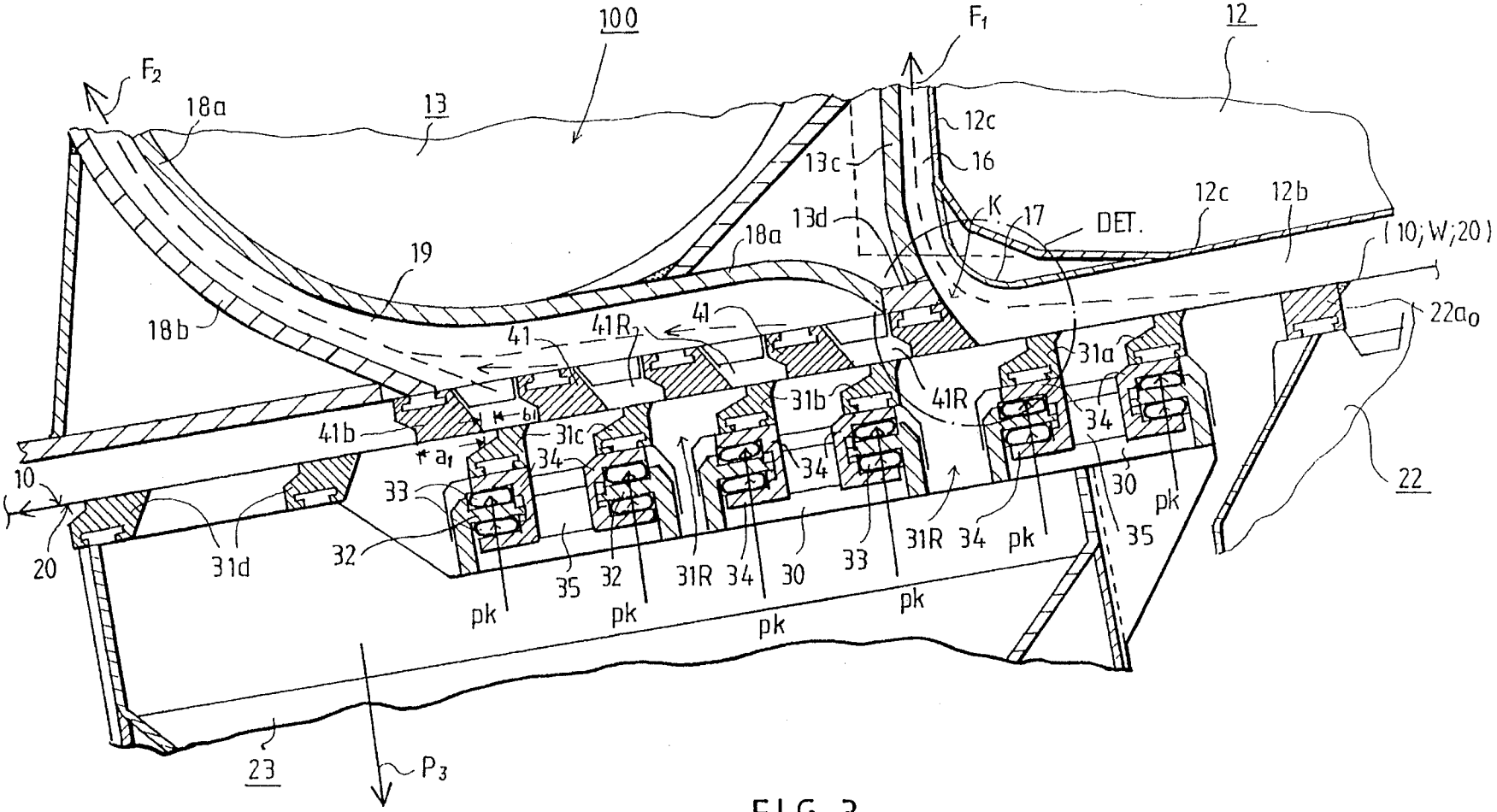
FIG. 3 is a detailed vertical sectional view in the machine direction of a twin-wire MB zone as shown in FIGS. 1 and 2.

Referring to FIGS. 1 to 3, the guide roll 11*a* of the upper wire 10 guides the upper wire onto the web W in the area of a ribbed deck 22*a* of the first forming shoe 22, preferably approximately at its fourth rib when the ribbed deck 22*a* comprises about 7 ribs, e.g., near the center of the ribbed deck. The ribbed deck 22*a* of the forming shoe 22 is placed inside the loop of the lower wire 20 and has a relatively large curve radius $R_1$ which is generally dimensioned in the range of about 3 m to about 12m, preferably in the range of about 5 to about 8 m. The open gap spaces in the ribbed deck 22*a* which are placed against the inner face of the lower wire 20 can be connected to a source of negative pressure through the frame box of the forming shoe 22, which is illustrated by the arrow $P_0$. In the area of the forming shoe 22, dewatering takes place mainly through the upper wire 10 by the effect of the tensioning pressure $p = T/_{R\ 1}$(T =tension of the wire 10) of the upper wire 10. This dewatering is promoted by the field of centrifugal force. The dry solids content $k_1$ of the web W is, at the beginning of the twin-wire zone, of an order of from about 1.0% to about 3%, preferably in the range of about 1.2% to about 1.8%.

As shown in FIGS. 1 to 3, the first forming shoe 22 is followed by a MB unit 100 arranged in accordance with the invention. The MB unit 100 comprises a first dewatering chamber 12 arranged inside the loop of the upper wire 10 and, immediately after this chamber, a second dewatering chamber 13. Chambers 12 and 13 communicate with a source 50 of negative pressure (suction) so that the negative pressures $P_{1}$ and $_{P\ 2}$ present inside the chambers 12 and 13 can be set or adjusted individually. The first chamber 12 is provided with a water drain duct 12*b*, which is preferably placed at the driving side of the machine only. In a corresponding manner, the second dewatering chamber 13 is provided with a corresponding water drain duct 13*b*. The first chamber 12 is attached to the frame parts 61 of the upper-wire unit 60 by means of support members 12*a*, and similarly the second chamber 13 is attached to the frame parts 61 of the upper-wire unit 60 by means of its support members 13*a*, if necessary, so that its position can be set or adjusted. A more detailed exemplifying embodiment of the twin-wire zone of the MB unit 100, which is shown in greater detail in FIGS. 3 and 4, will be described later.

Referring again to FIG. 1, the MB unit 100, which has been arranged in accordance with the invention, is followed by a "SymFormer"twin-wire zone similar to what is known from the prior art. After the MB unit 100, the twin-wire zone is guided by a forming roll 14 having a smooth-face 14'and a sector a on which the twin-wire zone is curved upward. The magnitude of the sector a is typically selected in the range of about 20° to about 45°. After the forming roll 14, a second forming shoe 24 is positioned. Forming shoe 24 has a ribbed deck 24*a* which may communicate with negative pressure if necessary and/or desired. The curve radius $R_2$ of the ribbed deck 24*a* of the forming shoe 24 is selected in the range of from about 2 m to about 6 m.

The second forming shoe 24 is followed by a forming roll 25 placed inside the loop of the lower wire 20. The twin-wire zone curves downwards on the sector b of the forming roll 25 which is in the range of about 30° to about 50°. Forming roll 25 preferably has a smooth-face 25'and has no suction zone. At the vicinity of the forming roll 24, inside the loop of the upper wire 10, there is a water drain box 15 and a water drain doctor 15*a* passing into the box 15. Thereafter, as shown in FIG. 1, the twin-wire zone runs downwardly inclined onto the guide or forming roll 11*b* placed inside the loop of the upper wire 10. The forming roll 11*b* returns the twin-wire zone to the plane T—T defined by the single-wire initial portion 21 or in proximity to this plane. After this, a pick-up device to transfer the web to the press section is arranged and comprises a pick-up fabric 52 and a pick-up roll 51 provided with a suction zone 51*a*. On the roll 51, the web W is separated from the lower wire 20 and is transferred into the press section of the paper machine (not shown).

In the following, with reference primarily to FIG. 3, a preferred exemplifying embodiment of the construction of the twin-wire MB zone in accordance with the present invention will be described. The twin-wire MB zone starts after the last forming rib 22*a* $_0$ of the first forming shoe 22 and is guided by the first pair of ribs 31*a* of the loading unit 23. After the last one of the pair of ribs 31*a*in the twin-wire zone, a first fixed dewatering and guide rib 41*a* is arranged to operate against the inner face of the upper-wire loop 10. The first rib 41*a* is followed by equivalent dewatering and guide ribs 41 which are uniformly spaced in the running direction of the web. The last one of the ribs is denoted by the reference 4l*b*.

As shown in FIG. 3, opposite to the fixed dewatering and guide ribs 41*a*,41, 41*b*, pairs of loading ribs 3l*b* and 31*c* operate. Ribs 31*a*, 31*b* are placed facing gap spaces 41R formed between the dewatering and loading ribs and are positioned inside the lower wire loop 20. The width $a_1$ of the front face of the dewatering and guide ribs 41 in the machine direction is preferably measured in the range of from about 50 mm to about 60 mm, and the width $b_1$ of the gap space between the ribs 31 and 41 in the machine direction, which space has no rubbing face, is preferably dimensioned in the range of from about 10 mm to about 15 mm. The pairs of ribs 31*b*,31*c* as well as the first pair of loading ribs 31*a* that precedes them are connected in pairs by means of connecting parts 35 to W-Section loading members 34. Members 34 define two interior chambers, one on each side of a central part, in which loading hoses 33 operate. By means of the pressures $P_k$, the pressure medium that is passed into these pairs of hoses, the pressure which presses the pairs of loading ribs 31*a*,31*b*,31*c* against the inner face of the lower-wire loop 20 can be regulated. The back-up supports for this loading consist of the dewatering and guide ribs 41*a*,41,41*b*, which are fixed. By means of the loading of the ribs 31*a*,31*b*,31*c*, the compression pressure between the wires 10,20 which removes water out of the web W and which is, in the MB zone, applied to the web W placed between the wires 10,20 is regulated.

The loading pressures $p_k$ between the different pairs of ribs 31*a*,31*b*,31*c* can be regulated separately in order to "profile" the loading in the running direction of the wires 10,20. The dewatering pressure can also be profiled in the transverse direction by arranging the loading hoses 33 so that they can be loaded with different pressures in the transverse direction by means of blocks 23*a*. The box of the loading unit 23 may communicate with negative pressure, which is illustrated by the arrow $P_3$. This application of negative pressure provides a dewatering effect through the lower wire 20 through the gap spaces 31R between the loading ribs 31.

In the following, with reference to FIGS. 2,3 and 4, the construction and the operation of the dewatering chambers 12 and 13 will be described in more detail.

A lower wall 12*c* of the first dewatering chamber 12 defines a gap space 12*b* above the ribbed deck 22*a* of the first forming shoe 22 and above the first pair of loading ribs 31*a*. Through this gap space 12*b*, water is drained that is derived mainly from the area of the ribbed deck 22*a* of the first forming shoe 22 as well as water that has been "doctored" by the first fixed dewatering and guide rib 41*a* from the inner face of the upper wire 10. These flows of water are passed into the first dewatering box 12 in the direction of the arrow $F_1$ through the drain duct 16. Duct 16 is placed in the space between the rear wall 12*c* of the first chamber 12 and a vertical wall 13*c* of the second chamber 13. The duct 16 forms a vertical suction-deflector duct through which the water is removed in the direction of the arrow $F_1$ into the first chamber 12, while being aided by the negative pressure $P_1$ present in chamber 12. Out of the first chamber 12, the water is drained through its drain duct 12*b*, which is preferably placed at the driving side of the machine only.

In connection with the lower wall of the second dewatering chamber 13, fixed dewatering and guide ribs 41 are placed, of which ribs the first rib 41*a* is fixed to the transverse rib 13*d* interconnecting the lower edges of the wall portions 13*c* and 18*a* by means of a dovetail joint 13*e*,14*c*(FIG. 4) or equivalent. Above the ribs 41, there is a curved wall 18*a*, which defines a drain duct 19 of the second chamber 13 together with the curved outer wall 18*b*. The last rib 4l*b* is placed in connection with the lower edge of the latter wall 18*b*. Water is drained in the direction of the arrow $F_2$ through the gap spaces 41R between the ribs 41 along the duct 19 into the second chamber 13, while being aided by the negative pressure P2 present in the chamber. The water is drained further out of the chamber 13 through its drain duct 13*b*, which is preferably placed at the driving side of the machine only.

In the loading unit 23, after the loading ribs 31*c*, a fixed pair of loading ribs 31*d*is placed. This pair of ribs 31*d*, together with the last rib $22a_0$ of the first forming shoe 22, define the inlet and outlet directions of the twin-wire zone. In the area between the ribs $22a_0$ and 31*d*, the twin-wire zone runs along a gently meandering path when loaded by the loading ribs 31 against the fixed ribs 41. In this manner, the ribs 31 and 41, which operate alternatively against one another, apply dewatering impulses to the web W which improve the formation and produce dewatering to some extent through the lower wire 20 and especially through the upper wire 10, if necessary, while being aided by negative pressures $P_{1\ ,P2\ ,P3}$.

The ribs 31*a*,31*b*,31*c*,31*d*,41,41*a*,41*b* have been constructed to be replaceable ribs that extend across the entire width of the wires 10,20. The ribs are made either of a wear-resistant material, for example of a ceramic, throughout, or are provided with a wear-resistant front face which operates against the inner faces of the wires 10,20, while the water drained out of the web W acts as a lubricant that reduces the wear and the friction. The same constructional details also apply with respect to the ribs 22*a* and 24*a* in the decks of the forming shoes 22 and 24.

After the MB zone, the dry solids content $k_2$ of the web W is generally of an order from about 3% to about 6% , preferably in the range of from about 4% to about 5%. After the second forming roll 25, the dry solids content $k_1$ of the web is typically of an order from about 6% to about 12% , preferably in the range from about 8% to about 10%. After the twin-wire zone, at the guide roll 11*c* of the upper wire 10, the dry solids content k4 is typically of an order from about 8% to about 14% , preferably in the range from about 10% to about 12%.

In the following, with reference to FIG. 4, a preferred exemplifying embodiment will be described of the lower part of the drain duct 16 of the first dewatering chamber 12. The dimensions and the shape of a throat K of the drain duct 16 of the chamber 12, placed at and above the first rib 41*a*, are highly critical depending on the amounts of water to be drained, on the speed of the machine, and on the paper grade produced. As is known from prior art, attempts have been made to regulate the width of the throat K by adjusting the position of the first dewatering chamber 12, e.g., by means of various lifting mechanisms. However, these devices are expensive, complicated, and they have not been able to provide a solution satisfactory under all circumstances, in particular not in respect of the shape of the throat K.

The present invention solves these problems by replacing the fixed curved wall 17 in FIG. 3 by a replaceable form rib 17*a* which is preferably made of plastic. Rib 17*a* is fixed to a fastening base 12*e* provided in connection with the plane lower wall 12*d* of the first box 12 by means of the dovetail groove 17*b* in the rib 17*a*. Ribs 17*a* are constructed and held in reserve, each of which has a different measures and different profile 17*c* of the outer face, so that, by replacing the ribs 17*a*, it is possible to set the width and the profile of the throat K in the draining direction $F_1$ and, if necessary, also in the transverse direction optimally. By means of replaceable ribs 17*a*, the construction can be made operative with different machine speeds, both in slower machines, in which the water follows the face of the upper wire 10, and in machines of higher speeds, in which the water moving in the space 12*b* rises apart from the inner face of the upper wire 10.

Above, the invention has been described with express reference to a construction of combination of a hybrid former and a MB former, which is also the most popular and the preferable application of the invention, in which the advantages of the invention are manifested with particular emphasis. However, the invention can also be applied in so-called gap formers, in which there is no single-wire initial portion 20*a*, but in which the pulp jet J is fed directly into the gap between the wires 10,20. In such a case, the dewatering and the dry solids content kl corresponding to the single-wire portion 20*a*are preferably accomplished on the forming roll, which operates at the same time as a breast roll, over which the twin-wire zone is curved on a certain sector, on which water is drained primarily through the outer wire, which wire then corresponds to the lower wire 20 in FIGS. 1 to 4. After the curved forming sector of the forming roll, -there follows the MB unit 100 described above and the other necessary dewatering stages in the twin-wire zone, which zone may be vertical or diagonally rising or, in an exceptional case, also substantially horizontal.

The examples provided above are not meant to be exclusive. Many other variations of the present invention would be obvious to those skilled in the art, and are contemplated to be within the scope of the appended claims.

We claim:

1. A twin-wire web former in a paper machine, including an initial web forming portion followed by a twin-wire zone defined by first and second wires, comprising a first forming shoe having a ribbed deck arranged after the initial forming portion in a loop of one of said wires, said twin-wire zone beginning in the area of the ribbed deck, a pressure-loaded dewatering unit arranged after said first forming shoe in the running direction of the twin-wire zone, said dewatering unit comprising dewatering chambers on one side of said twin-wire zone and first and second sets of ribs situated on opposite sides of said twin-wire zone, a first one of said dewatering chambers having a suction-deflector duct, said first dewatering chamber arranged in opposed relationship to said first forming shoe for removing water that drains from the area of the ribbed deck through said suction-deflector duct, a second one of said dewatering chambers arranged after said first dewatering chamber in the running direction of said twin-wire zone, said second chamber having a lower part and a drain duct for drawing water into said second chamber, said first set of ribs being coupled to said lower part of said second dewatering chamber and defining gap spaces between ribs therein opening into said drain duct of said second dewatering chamber, said first set of ribs comprising dewatering and guide ribs, a first rib of said first set of ribs comprising a deflector rib defining a throat in a lower portion of said suction-deflector duct of said first dewatering chamber said first set of ribs further comprising a rib block defined after said first rib of said first set of ribs, said rib block leading into said drain duct of said second dewatering chamber and terminating with a last rib of said first set of ribs, said second set of ribs arranged opposite said first set of ribs on an opposite side of the twin-wire zone from the side of the twin-wire zone on which said first set of ribs are arranged, said second set of ribs comprising loading ribs with loading hoses, said loading ribs operative by means of pressure passed through said loading hoses and a loading unit arranged in a loop of said first wire after said first forming shoe in the running direction of the twin-wire zone, said loading unit comprising a frame part, said second set of ribs being arranged in said loading unit, said first set of ribs being arranged inside a loop of said second wire and comprising from 4 to 7 ribs, said second set of ribs comprising at least one fixed guide rib arranged in the twin-wire zone after said last rib of said first set of ribs in the runnina direction of the twin-wire zone, said at least one fixed guide rib being fixed to said frame part of said loading unit.

2. Web former of claim 1, wherein a single rib or a pair of ribs of said second set of ribs is arranged in opposed relationship to a lower surface of said first dewatering chamber before said first rib of said first set of ribs, a gap space being defined opposite said first dewatering chamber between said single rib or said pair of ribs of said second set of ribs, said first rib of said first set of ribs, said lower surface of said first dewatering chamber and said first forming shoe, said throat opening into said gap space to draw the water therefrom.

3. Web former of claim 2, wherein said loading unit comprises a frame box, said first forming shoe and/or said frame box of said loading unit being coupled to a source of negative pressure.

4. Web former of claim 1, wherein each of said first and second dewatering chambers communicates with a source of negative pressure so that the negative pressure present in said dewatering chambers is independently adjustable and/or regulatable, said dewatering chambers communicating with respective drain ducts only at a driving side of the web former.

5. Web former of claim 1 further comprising a replaceable form rib coupled to said first dewatering chamber and spaced from said twin-wire zone such that said replaceable form rib does not contact either one of said first and second wires, said throat being defined between said replaceable form rib and said first rib of said first set of ribs.

6. Web former of claim 5, wherein said first dewatering chamber has a lower part, the web former further comprising coupling means for connecting said replaceable form rib to an outer face of said lower wall of said first dewatering chamber, said coupling means comprising a groove-projection joint means arranged on respective surfaces of said lower wall of said first dewatering chamber and said replaceable form rib.

7. Web former of claim 1, further comprising a replaceable form rib arranged on said first dewatering chamber in opposed relationship to said first rib of said first set of ribs for dimensioning the size of said throat and/or adjusting the profile of said throat .

8. Web former of claim 1, wherein said initial web forming portion is a single-wire forming zone running in a plane, said twin-wire zone being curved downward on said curved ribbed deck of said first forming shoe from said plane of the single-wire initial portion, said twin-wire zone continuing in a downward inclined run guided by said first and second sets of ribs, said first set of ribs being arranged in a loop of said first wire,the web former further comprising a first forming roll arranged after said dewatering unit in said twin-wire zone inside the loop of said second wire, said first forming roll having a smooth solid face for curving said twin-wire zone into an upward inclined run, a second forming shoe arranged inside a loop of said first wire, said second forming shoe comprising a curved ribbed deck having a direction of curvature opposite to the direction of curvature of said first forming roll, said twin-wire zone being curved in the area of said ribbed deck of said second forming shoe, and a second forming roll arranged after said second forming shoe inside said loop of said first wire, said twin-wire zone being curved on said second forming roll into a downward inclined run, the curve radius of said second forming roll being smaller than the curve radius of said second forming shoe.

9. Web former of claim 8, further comprising a press roll arranged after said second forming roll inside said loop of said second wire, said press roll guiding said twin-wire zone to approach the plane in which said single-wire initial portion runs, first means for separating the web from said second wire so that the web follows said first wire, and second means for separating the web from said first wire in conjunction with a suction zone of a pick-up roll and transfer the web onto a pick-up fabric to carry the web into a press section.

10. Web former of claim 1, wherein the dry solids content of the web at a beginning of said twin-wire zone is from about 1.0% to about 3% , and the dry solids content of the web when it departs from said twin-wire zone is from about 8% to about 14%.

11. Web former of claim 10, wherein the dry solids content of the web at a beginning of said twin-wire zone is from about 1.2% to about 1.8% , and the dry solids content of the web when it departs from said twin-wire zone is from about 10% to about 12%.

12. Web former of claim 1, wherein a pair of ribs of said second set of ribs is arranged in opposed relationship to said first dewatering chamber before a first rib of said first set of ribs, the web former further comprising connecting means for connecting said pair of ribs of said second set of ribs.

13. An arrangement, for dewatering a web, in a twin-wire forming zone defined between first and second wires between which a web is dewatered and including a forming shoe comprising a curved ribbed deck and arranged in a loop of said first wire, comprising first dewatering means situated in opposed relationship to said forming shoe in a loop of said second wire, said first dewatering means comprising a first drain duct situated proximate to said forming shoe for drawing water that has been removed from the web in the area of said curved ribbed deck and a replaceable form rib arranged proximate to said first drain duct and spaced from the twin, wire zone such that said form rib does not contact either one of said first and second wires said form rib defining the size and shape of said first drain duct, second dewatering means arranged after said first dewatering means in the running direction of the twin-wire zone and in said loop of said second wire, said second dewatering means comprising a lower part and a second drain duct, a first set of ribs coupled to said lower part of said second dewatering means, said first set of ribs defining gap spaces between ribs opening into said second drain duct such that water from the web is passed through said gap spaces into said second drain duct, said first set of ribs comprising dewatering and guide ribs, a second set of ribs arranged substantially opposite said first set of ribs in said loop of said first wire, said second set of ribs comprising loading ribs for loading the twin-wire zone and means for loading/pressing said loading ribs, and connecting means for detachably connecting said form rib to a lower surface of said first dewatering means, said connecting means comprising a fastening base connected to said lower surface and a corresponding dovetail joint arranged in said form rib.

14. The arrangement of claim 13 wherein said second set of ribs comprise a pair of ribs arranged before a first rib of said first set of ribs and opposite a lower surface of said first dewatering means, said first rib of said first set of ribs comprising a deflector rib for doctoring water from an upper face of said second wire, a gap space being defined opposite said first dewatering means between said pair of ribs of said second set of ribs, said first rib of said first set of ribs, said lower surface of said first dewatering means and said curved ribbed deck, said first drain duct opening into said gap space to draw the water therefrom.

15. The arrangement of claim 13, wherein said first set of ribs and second set of ribs comprise replaceable ribs extending across the width of said upper and lower wires, said replaceable ribs comprising a wear-resistant material or having a wear-resistant front face which contacts the inner faces of said upper and lower wires.

16. A method for dewatering a web in a twin-wire forming zone defined between first wire and second wires and including a forming shoe comprising a curved ribbed deck arranged in a loop of said first wire, comprising the steps of:

drawing water that has been removed from the web in the area of said curved ribbed deck into a first dewatering chamber via a first drain duct, providing a first set of ribs in a loop of said second wire, drawing water from the web through gap spaces defined between ribs in said first set of ribs into a second dewatering chamber via a second drain duct, said second dewatering chamber being arranged after said first dewatering chamber in the running direction of the twin-wire zone, arranging a second set of ribs in a loop of said first wire substantially opposite to said first set of ribs, loading said second set of ribs to press said first wire and force water from the web, arranging a form rib proximate said first drain duct and spaced from the twin-wire zone such that said replaceable form rib does not contact either one of said first and second wires said form rib defining the size and shape of said first drain duct and detachably connecting said form rib to a lower wall of Said first dewatering means by connecting a fastening base to said lower wall and arranging a corresponding dovetail joint in conjunction with said form rib.

17. The method of claim 16, further comprising the step of regulating the pressure applied to said second set of ribs in the running direction of the twin-wire zone and/or in a direction transverse to the running direction of the twin-wire zone.

18. A twin-wire web former in a paper machine, including an initial web forming portion followed by a twin-wire zone defined by first and second wires, comprising a first forming shoe having a ribbed deck arranged after the initial forming portion in a loop of one of said wires, said twin-wire zone beginning in the area of the ribbed deck, a pressure-loaded dewatering unit arranged after said first forming shoe in the running direction of the twin-wire zone, said dewatering unit comprising dewatering chambers on one side of said twin-wire zone and first and second sets of ribs situated on opposite sides of said twin-wire zone, a first one of said dewatering chambers having a suction-deflector duct, said first dewatering chamber arranged in opposed relationship to said first forming shoe for removing water that drains from the area of the ribbed deck through said suction-deflector duct, said suction-deflector duct of said first dewatering chamber comprising a throat part and said first dewatering chamber having a lower part, a second one of said dewatering chambers arranged after said first dewatering chamber in the running direction of said twin-wire zone, said second chamber having a lower part and a drain duct for drawing water into said second chamber, said first set of ribs being coupled to said lower part of said second dewatering chamber and defining gap spaces between ribs therein opening into said drain duct of said second dewatering chamber, said first set of ribs comprising dewatering and guide ribs, said second set of ribs arranged opposite said first set of ribs on an opposite side of the twin-wire zone from the side of the twin-wire zone on which said first set of ribs are arranged, said second set of ribs comprising loading ribs with loading hoses, said loading ribs operative by means of pressure passed through said loading hoses, a replaceable form rib coupled to said first dewatering chamber and spaced from said twin-wire zone such that said replaceable form rib does not contact either one of said first and second wires, said throat part of said suction-deflector duct being formed between said replaceable form rib and said twin-wire zone, and coupling means for connecting said replaceable form rib to an outer face of said lower part of said first dewatering chamber, said coupling means comprising a groove-projection joint means arranged on respective surfaces of said lower part of said first dewatering chamber and said replaceable form rib.

* * * * *